US009001012B2

(12) United States Patent
Yumoto

(10) Patent No.: US 9,001,012 B2
(45) **Date of Patent: *Apr. 7, 2015**

(54) IMAGE DISPLAY

(71) Applicant: Sony Corporation, Tokyo (JP)

(72) Inventor: Akira Yumoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/295,392

(22) Filed: Jun. 4, 2014

(65) Prior Publication Data

US 2014/0285408 A1 Sep. 25, 2014

Related U.S. Application Data

(63) Continuation of application No. 11/802,461, filed on May 23, 2007.

(30) Foreign Application Priority Data

May 29, 2006 (JP) ..... 2006-147536

(51) Int. Cl.
*G09G 3/30* (2006.01)
*G09G 3/32* (2006.01)

(52) U.S. Cl.
CPC ..... *G09G 3/3225* (2013.01); *G09G 3/3233* (2013.01); *G09G 2300/043* (2013.01); *G09G 2300/0819* (2013.01); *G09G 2300/0861* (2013.01); *G09G 2300/0866* (2013.01); *G09G 2320/0233* (2013.01); *G09G 2320/043* (2013.01); *G09G 2310/0267* (2013.01)

(58) Field of Classification Search
CPC ..... G09G 3/3233
USPC ..... 345/76
See application file for complete search history.

(56) References Cited

U.S. PATENT DOCUMENTS

| | | | | |
|---|---|---|---|---|
| 5,670,792 | A | 9/1997 | Utsugi et al. | |
| 5,859,630 | A * | 1/1999 | Huq | 345/100 |
| 6,198,464 | B1 | 3/2001 | Ota et al. | |
| 6,525,704 | B1 * | 2/2003 | Kondo et al. | 345/78 |
| 7,432,888 | B2 | 10/2008 | Kwak | |

(Continued)

FOREIGN PATENT DOCUMENTS

| | | | |
|---|---|---|---|
| JP | 08-234683 | A | 9/1996 |
| JP | 2002-215096 | A | 7/2002 |

(Continued)

OTHER PUBLICATIONS

Japanese Office Action issued Dec. 1, 2012 for corresponding Japanese Application No. 2006-147536.

(Continued)

*Primary Examiner* — Dorothy Harris
(74) *Attorney, Agent, or Firm* — Rader, Fishman & Grauer PLLC

(57) ABSTRACT

Herein disclosed an image display including: row scan lines configured to supply a control signal; column signal lines configured to supply a video signal; and pixel circuits configured to be disposed at intersections between the scan lines and the signal lines, wherein each of the pixel circuits has at least a drive transistor, a sampling transistor connected to a gate of the drive transistor, a capacitive part connected between the gate and a source of the drive transistor, and a light-emitting element connected to the source of the drive transistor.

16 Claims, 18 Drawing Sheets

(56) References Cited

U.S. PATENT DOCUMENTS

| | | | | |
|---|---|---|---|---|
| 7,542,019 | B2 | 6/2009 | Park et al. | |
| 2003/0107565 | A1 | 6/2003 | Libsch et al. | |
| 2003/0112205 | A1 | 6/2003 | Yamada | |
| 2004/0070557 | A1 | 4/2004 | Asano et al. | |
| 2004/0196223 | A1 | 10/2004 | Kwon | |
| 2005/0237281 | A1 | 10/2005 | Tam | |
| 2005/0269959 | A1 | 12/2005 | Uchino et al. | |
| 2006/0152459 | A1* | 7/2006 | Shin | 345/94 |
| 2007/0132674 | A1 | 6/2007 | Tsuge | |

FOREIGN PATENT DOCUMENTS

| | | | |
|---|---|---|---|
| JP | 2003-186437 | A | 7/2003 |
| JP | 2004-334163 | A | 11/2004 |
| JP | 2005-107233 | A | 4/2005 |
| JP | 2005-266309 | A | 9/2005 |
| JP | 2005-345722 | | 12/2005 |
| JP | 2006-084509 | A | 3/2006 |
| JP | 2006-215213 | | 8/2006 |
| KR | 2003-0051360 | A | 6/2003 |

OTHER PUBLICATIONS

Korean Intellectual Property Office Notice Requesting Submission of Opinion issued Aug. 14, 2013 for corresponding Korean Application No. 10-2007-0051216.

Japanese Office Action issued Jan. 23, 2014 for corresponding Japanese Application No. 2006-147536.

* cited by examiner

RELATED ART

RELATED ART

RELATED ART

IMAGE DISPLAY

CROSS REFERENCES TO RELATED APPLICATIONS

This is a Continuation application of U.S. patent application Ser. No. 11/802,461, filed May 23, 2007, which in turn claims priority from Japanese Application No.: 2006-147536, filed in the Japan Patent Office on May 29, 2006, the entire contents of which being incorporated herein by reference.

BACKGROUND OF THE INVENTION

1. Field of the Invention

The present invention relates to an image display including pixel circuits for driving light-emitting elements provided on each pixel basis by current. More specifically, the invention relates to a so-called active-matrix image display in which pixel circuits are arranged in a matrix (in rows and columns) and, in particular, the amounts of currents applied to light-emitting elements such as organic EL elements are controlled by insulated-gate field effect transistors provided in the pixel circuits.

2. Description of the Related Art

In an image display, e.g., in a liquid crystal display, a large number of liquid crystal pixels are arranged in a matrix, and the transmittance intensity or reflection intensity of incident light is controlled on each pixel basis in accordance with information on an image to be displayed, to thereby display the image. This pixel-by-pixel control is implemented also in an organic EL display employing organic EL elements for its pixels. The organic EL element however is a self-luminous element unlike the liquid crystal pixel. Therefore, the organic EL display has the following advantages over the liquid crystal display: higher image visibility, no necessity for a backlight, and higher response speed. Furthermore, the organic EL display is a current-control display, which can control the luminance level (grayscale) of each light-emitting element based on the current flowing through the light-emitting element, and hence is greatly different from the liquid crystal display, which is a voltage-control display.

The kinds of drive systems for the organic EL display include a simple-matrix system and an active-matrix system similarly to the liquid crystal display. The simple-matrix system has a simpler configuration but involves problems such as a difficulty in the realization of a large-size and high-definition display. Therefore, currently, the active-matrix displays are being developed more actively. In the active-matrix system, a current that flows through a light-emitting element in each pixel circuit is controlled by active elements (typically thin film transistors (TFTs)) provided in the pixel circuit. An example of the pixel circuit is disclosed in Japanese Patent Laid-open No. Hei 8-234683.

FIG. 1 is a circuit diagram showing a typical example of an existing pixel circuit. As shown in the drawing, the existing pixel circuit is disposed at the intersection between a row scan line WS that supplies a control signal and a column signal line SL that supplies a video signal. The pixel circuit includes at least a sampling transistor T1, a pixel capacitor Cs serving as a capacitive part, a drive transistor Td, and a light-emitting element OLED. The sampling transistor T1 conducts in response to the control signal (selection pulse) supplied from the scan line WS to thereby sample the video signal supplied from the signal line SL. The pixel capacitor Cs holds an input voltage dependent upon the sampled video signal. The drive transistor Td is connected to a power supply line Vcc and supplies an output current to the light-emitting element OLED depending on the input voltage held by the pixel capacitor Cs. The light-emitting element OLED is a two-terminal element (diode-type element). The anode thereof is connected to the drive transistor Td, while the cathode thereof is connected to a ground line GND. The light-emitting element OLED emits light with a luminance dependent upon the video signal due to the output current (drain current) supplied from the drive transistor Td. In general, the output current (drain current) has a dependency on the carrier mobility in the channel region of the drive transistor Td and the threshold voltage of the drive transistor Td.

The drive transistor Td receives by its gate the input voltage held by the pixel capacitor (capacitive part) Cs and conducts the output current between its source and drain, to thereby apply the current to the light-emitting element OLED. The light-emitting element OLED is formed of e.g. an organic EL device, and the light emission luminance thereof is in proportion to the amount of the current applied thereto. The amount of the output current supplied from the drive transistor Td is controlled by the gate voltage, i.e., the input voltage written to the pixel capacitor Cs. The existing pixel circuit changes the input voltage applied to the gate of the drive transistor Td depending on the input video signal, to thereby control the amount of the current supplied to the light-emitting element OLED.

The operating characteristic of the drive transistor is expressed by Equation 1.

$$Ids=(1/2)\mu(W/L)Cox(Vgs-Vth)^2 \qquad \text{Equation 1}$$

In Equation 1, Ids denotes the drain current flowing between the source and drain. This current is the output current supplied to the light-emitting element in the pixel circuit. Vgs denotes the gate voltage applied to the gate with respect to the potential at the source. The gate voltage is the above-described input voltage in the pixel circuit. Vth denotes the threshold voltage of the transistor. μ denotes the mobility in the semiconductor thin film serving as the channel of the transistor. In addition, W, L and Cox denote the channel width, channel length and gate capacitance, respectively. As is apparent from Equation 1 as a transistor characteristic equation, when a thin-film transistor operates in its saturation region, the transistor is turned on to conduct the drain current Ids if the gate voltage Vgs is higher than the threshold voltage Vth. In principle, a constant gate voltage Vgs invariably supplies the same drain current Ids to the light-emitting element as shown by Equation 1. Therefore, supplying video signals at the same level to all the pixels in a screen will allow all the pixels to emit light with the same luminance, and thus will offer uniformity of the screen.

However, actual thin film transistors (TFTs) formed of a semiconductor thin film such as a poly-silicon film involve variation in the device characteristics. In particular, the threshold voltage Vth is not constant but varies from pixel to pixel. As is apparent from Equation 1, even if the gate voltage Vgs is constant, variation in the threshold voltage Vth of the drive transistors leads to variation in the drain current Ids. Thus, the luminance varies from pixel to pixel, which spoils uniformity of the screen.

To address this, there has been developed a pixel circuit provided with a function to cancel the variation in the threshold voltage of drive transistors. This pixel circuit is disclosed in e.g. Japanese Patent Laid-open No. 2005-345722.

The pixel circuit provided with the function to cancel variation in the threshold voltage Vth can improve uniformity of a screen and can address luminance variation due to changes of the threshold voltage over time. However, to provide the pixel circuit with the threshold voltage cancel function, there is a need to add at least three transistors to the sampling transistor and the drive transistor. In addition, these added transistors need to be line-sequentially scanned at timings different from the timings for the sampling transistors. Consequently, unlike the simple pixel circuit shown in FIG. 1, at least four scan lines are required for pixels on one row, and correspondingly scanners for line-sequentially scanning the respective scan lines at different timings are required. That is, compared with in the simple pixel circuit shown in FIG. 1, the number of the scanners is increased by three for the line-sequential scanning of the pixels provided with the threshold voltage cancel function. When the pixel circuits are formed by an amorphous-silicon TFT process, the scanners are formed of external components in general. Therefore, the increase in the number of the scanners directly leads to increase in the manufacturing costs. When the pixel circuits are formed by a low-temperature poly-silicon TFT process, it is possible to form the scanners by use of poly-silicon TFTs simultaneously. However, the increase in the number of the scanners contributes to a yield decrease and requires the space for arrangement of the scanners on the substrate. As a result, the manufacturing costs increase.

SUMMARY OF THE INVENTION

There is a need for the present invention to provide an image display that is allowed to have a reduced number of scanners, while allowing pixel circuits to have a function to cancel variation in the threshold voltage Vth of drive transistors. According to an embodiment of the present invention, there is provided an image display that includes row scan lines configured to supply a control signal, column signal lines configured to supply a video signal, and pixel circuits configured to be disposed at the intersections between the scan lines and the signal lines. In this image display, each of the pixel circuits includes at least a drive transistor, a sampling transistor connected to the gate of the drive transistor, a capacitive part connected between the gate and source of the drive transistor, and a light-emitting element connected to the source of the drive transistor. The sampling transistor conducts in response to a control signal supplied from the scan line during a predetermined sampling period to thereby sample a video signal supplied from the signal line in the capacitive part. The capacitive part applies an input voltage between the gate and source of the drive transistor depending on the sampled video signal. The drive transistor supplies an output current dependent upon the input voltage to the light-emitting element during a predetermined light emission period. The light-emitting element emits light with a luminance dependent upon the video signal due to the output current supplied from the drive transistor. Each of the pixel circuits includes a reference potential setting transistor connected to the gate of the drive transistor. The reference potential setting transistor is turned on/off by a control signal applied to the scan line on a row that is previous to the row of the reference potential setting transistor in terms of video signal sampling order, and sets the potential of the gate of the drive transistor to a reference potential in advance prior to video signal sampling.

According to another embodiment of the present invention, there is provided another image display that includes row scan lines configured to supply a control signal, column signal lines configured to supply a video signal, and pixel circuits configured to be disposed at the intersections between the scan lines and the signal lines. In this image display, each of the pixel circuits includes at least a drive transistor, a sampling transistor connected to the gate of the drive transistor, a capacitive part connected between the gate and source of the drive transistor, and a light-emitting element connected to the source of the drive transistor. The sampling transistor conducts in response to a control signal supplied from the scan line during a predetermined sampling period to thereby sample a video signal supplied from the signal line in the capacitive part. The capacitive part applies an input voltage between the gate and source of the drive transistor depending on the sampled video signal. The drive transistor supplies an output current dependent upon the input voltage to the light-emitting element during a predetermined light emission period. The light-emitting element emits light with a luminance dependent upon the video signal due to the output current supplied from the drive transistor. Each of the pixel circuits includes an initialization transistor connected to the source of the drive transistor. The initialization transistor is turned on/off by a control signal applied to the scan line on a row that is previous to the row of the initialization transistor in terms of video signal sampling order, and initializes the potential of the source of the drive transistor to a predetermined potential in advance prior to video signal sampling.

According to further another embodiment of the present invention, there is provided further another image display that includes row scan lines configured to supply a control signal, column signal lines configured to supply a video signal, and pixel circuits configured to be disposed at the intersections between the scan lines and the signal lines. In this image display, each of the pixel circuits includes at least a drive transistor, a sampling transistor connected to the gate of the drive transistor, a capacitive part connected between the gate and source of the drive transistor, and a light-emitting element connected to the source of the drive transistor. The sampling transistor conducts in response to a control signal supplied from the scan line during a predetermined sampling period to thereby sample a video signal supplied from the signal line in the capacitive part. The capacitive part applies an input voltage between the gate and source of the drive transistor depending on the sampled video signal. The drive transistor supplies an output current dependent upon the input voltage to the light-emitting element during a predetermined light emission period. The light-emitting element emits light with a luminance dependent upon the video signal due to the output current supplied from the drive transistor. Each of the pixel circuits includes an initialization transistor connected to the source of the drive transistor and a reference potential setting transistor connected to the gate of the drive transistor. The initialization transistor is turned on/off by a control signal applied to the scan line on a row that is previous to the row of the initialization transistor in terms of video signal sampling order, and initializes the potential of the source of the drive transistor to a predetermined potential in advance prior to video signal sampling. The reference potential setting transistor is turned on/off by a control signal applied to the scan line on a row that is previous to the row of the reference potential setting transistor in terms of video signal sampling order, and sets the potential of the gate of the drive transistor to a reference potential in advance prior to video signal sampling and at or after the timing of the initialization of the potential of the source of the drive transistor.

According to the embodiments of the present invention, in order to provide the pixel circuits with a function to cancel variation in the threshold voltage of the drive transistors, the initialization transistor and the reference potential setting transistor are incorporated into each pixel circuit. The initialization transistor is to initialize the source potential of the drive transistor. The reference potential setting transistor is to set the gate potential of the drive transistor to a reference potential. By carrying out the initialization and the setting to the reference potential, the threshold voltage cancel function can be realized. In particular, in the embodiments of the present invention, the initialization operation of the initialization transistor is carried out by utilizing a control signal for video signal sampling applied to a scan line on a row previous to the row of this initialization transistor. This allows the scanner for line-sequentially scanning the sampling transistors to be used also for line-sequential scanning of the initialization transistors, and thus eliminates the need to have the scanner dedicated to the initialization transistors. Furthermore, the reference potential setting operation of the reference potential setting transistor is controlled by utilizing a sampling control signal applied to a scan line on a row previous to the row of this reference potential setting transistor. This allows the scanner for sampling to be shared similarly, which eliminates the need to have the scanner dedicated to the setting to the reference potential. Consequently, it is possible to provide an image display at lower cost while allowing the pixel circuits to have the Vth cancel function.

DETAILED DESCRIPTION OF THE PREFERRED EMBODIMENTS

Embodiments of the present invention will be described below in detail with reference to the accompanying drawings.

Figure 1:
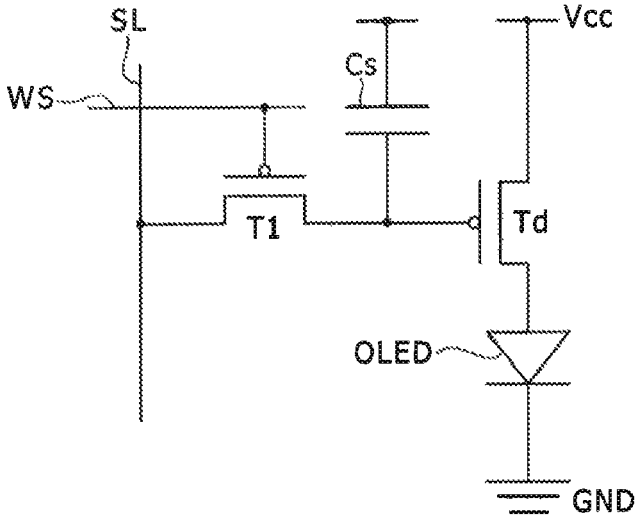
FIG. 1 is a circuit diagram showing one example of an existing pixel circuit.
Figure 2:
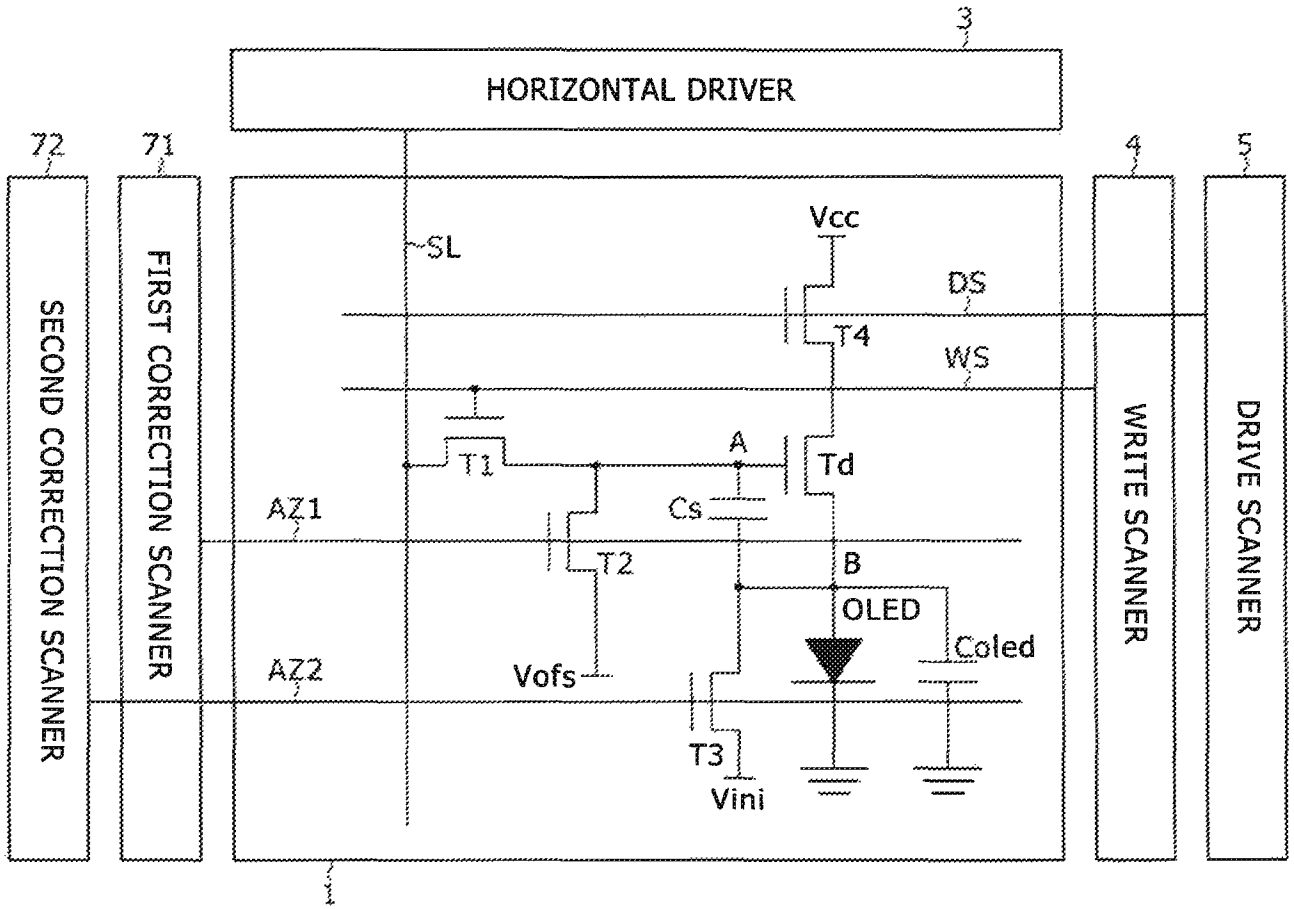
FIG. 2 is a block diagram showing an image display according to a related art.

Initially, to clarify the background of the present invention, an image display according to a related art as a basis of the present invention will be described below with reference to FIG. 2. Details of this image display according to the related art are disclosed in Japanese Patent Application No. 2005-027028 by the present assignee. A large part of the image display according to the related art is in common with image displays according to embodiments of the present invention, and therefore the image display according to the related art will be described below as a part of the present invention. As shown in FIG. 2, the image display is formed of a pixel array 1 and a peripheral circuit part. The pixel array 1 includes pixel circuits 2 arranged in rows and columns and serves as a screen. The peripheral circuit part includes four scanners 4, 5, 71, and 72 to line-sequentially scan the pixel array 1. Furthermore, the peripheral circuit part includes a horizontal driver 3 for supplying video signals to the pixel array 1.

Each pixel circuit 2 is disposed at the intersection between a row scan line WS and a column signal line SL. FIG. 2 shows only one pixel circuit 2 for easy understanding. The signal line SL is connected to the horizontal driver 3. The scan line WS is connected to the write scanner 4. The image display includes, besides the scan line WS for signal sampling, additional scan lines DS, AZ1, and AZ2. These scan lines DS, AZ1, and AZ2 are disposed in parallel to the sampling scan line WS. The scan line DS is connected to the drive scanner 5 and controls the light emission period. The scan line AZ1 is connected to the first correction scanner 71 and used for reference potential setting operation. The scan line AZ2 is connected to the second correction scanner 72 and used for initialization operation.

The pixel circuit 2 includes five transistors T1, T2, T3, T4, and Td, one pixel capacitor Cs, and one light-emitting element OLED. In the present example, all the transistors are N-channel transistors. However, the present invention is not limited thereto. The pixel circuit can be formed by adequately mixing N-channel transistors and P-channel transistors. The gate of the drive transistor Td is connected to a node A. The source thereof is connected to a node B. The drain thereof is connected via the switching transistor T4 to a power supply line Vcc. The sampling transistor T1 is connected between the signal line SL and the node A. The gate of the sampling transistor T1 is connected to the scan line WS. The transistor T2 for setting to a reference potential (hereinafter, referred to as "reference potential setting transistor T2") is connected between the node A and a predetermined reference potential Vofs. The gate thereof is connected to the scan line AZ1. The initialization transistor T3 is connected between the node B and a predetermined initialization potential Vini. The gate thereof is connected to the scan line AZ2. The switching transistor T4 is connected between the power supply line Vcc and the drive transistor Td. The gate thereof is connected to the scan line DS. The pixel capacitor Cs is connected between the nodes A and B. In other words, the pixel capacitor Cs is connected between the gate and source of the drive transistor Td. The light-emitting element OLED is formed of a two-terminal device such as an organic EL element. The anode thereof is connected to the node B, while the cathode thereof is connected to the ground. An equivalent capacitor Coled of the light-emitting element OLED is also shown in the drawing.

As shown in the drawing, this image display employs the following four scanners in order to line-sequentially scan the pixel array 1: the write scanner 4, the drive scanner 5, the first correction scanner 71, and the second correction scanner 72. This correspondingly causes increase in the manufacturing costs.

Figure 3:
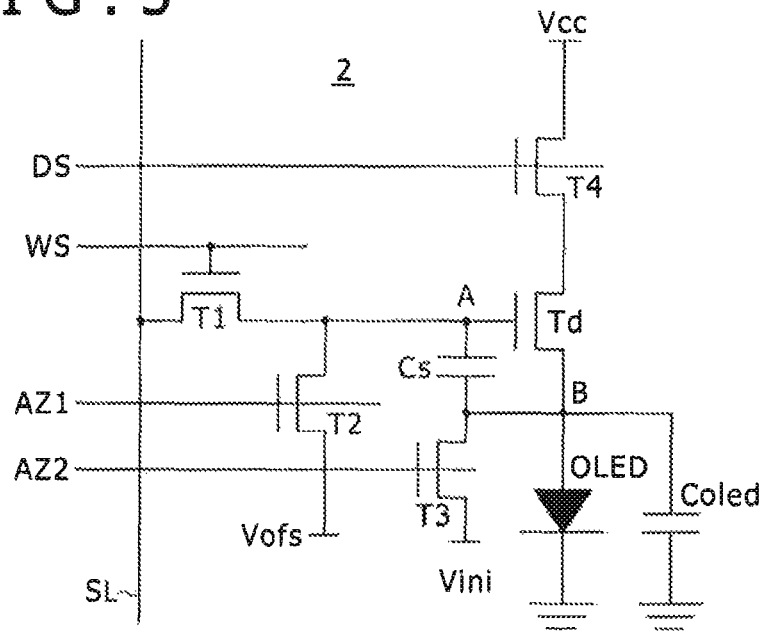
FIG. 3 RELATED ART
FIG. 3 is a circuit diagram showing a pixel circuit included in the image display shown in FIG. 2.

FIG. 3 schematically shows only the pixel circuit 2 extracted from the pixel array 1 shown in FIG. 2.

Figure 4:
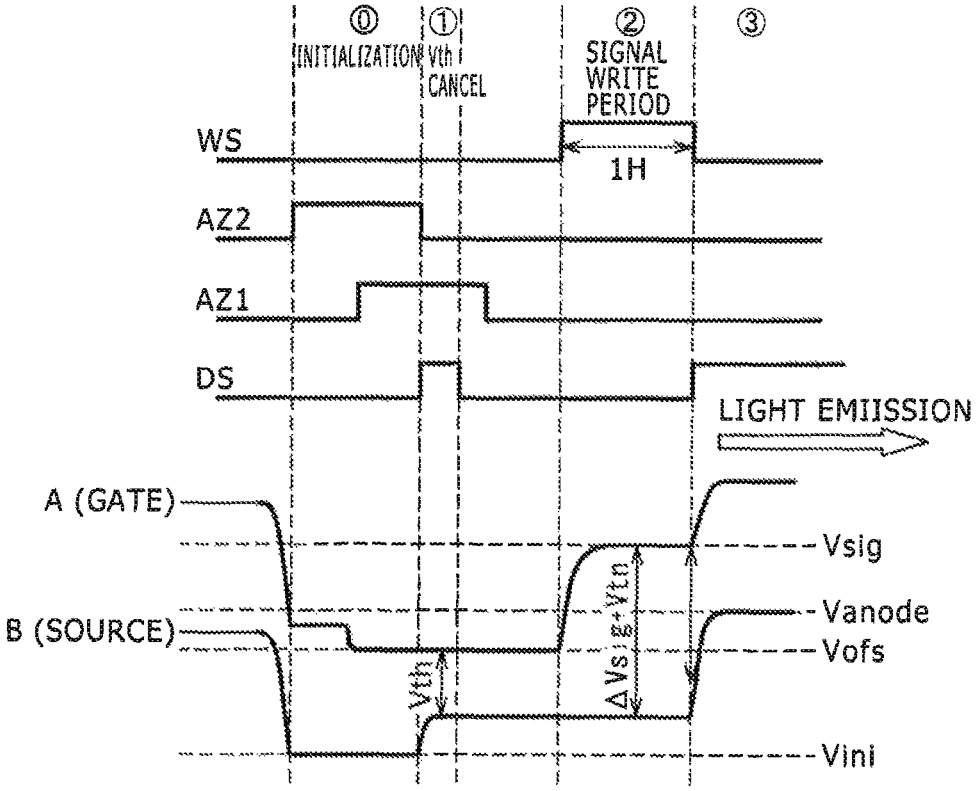
FIG. 4 RELATED ART
FIG. 4 is a timing chart for explaining the operation of the image display according to the related art shown in FIG. 2.

FIG. 4 is a timing chart for explaining the operation of the image display shown in FIG. 2. FIG. 4 shows the waveforms of control signals that are line-sequentially output from the respective scanners 4, 5, 71, and 72. In FIG. 4, each of the control signals (gate selection pulses) applied to the corresponding scan line is indicated by the same symbol as that of the corresponding scan line for easy understanding. Specifically, the control signal for sampling applied to the sampling scan line WS is also indicated by symbol WS, and the control signal for initialization applied to the initialization scan line AZ2 is also indicated by symbol AZ2. Furthermore, the control signal for setting to the reference potential, applied to the scan line AZ1, is also indicated by symbol AZ1. In addition, the control signal applied to the scan line DS is also indicated by symbol DS. In addition to the waveforms of these control signals, the potential changes at the nodes A and B are also indicated in FIG. 4. The potential change at the node A indicates the change of the gate potential of the drive transistor Td. The potential change at the node B indicates the potential change at the source of the drive transistor Td.

The respective scanners 4, 5, 71, and 72 shown in FIG. 2 output the corresponding control signal in a time-series manner, so that the operations of steps 0 to 3 are sequentially carried out. In the timing chart of FIG. 4, each step is represented as a number surrounded by a circle. At first, initialization operation is carried out in the step 0. Subsequently, Vth cancel operation is carried out in the step 1. Furthermore, signal write operation (sampling operation) is carried out in the step 2, followed by light emission operation in the step 3. The steps 0 to 3 are line-sequentially carried out in each one field, so that an image of one field is displayed on the pixel array 1.

In the initialization step 0, the control signal AZ2 is at the high level, and hence the N-channel transistor T3 is in the on-state. Thus, the source potential of the drive transistor Td becomes the initialization potential Vini. Subsequently, in the Vth cancel step 1, the control signals AZ1 and DS are at the high level, and hence the N-channel transistors T2 and T4 are in the on-state. As a result, the gate potential of the drive transistor Td becomes the reference potential Vofs. Because the potentials are set to satisfy the relationship Vofs−Vini>Vth, a current flows through the drive transistor Td and the source potential rises from the potential Vini. When the voltage between the gate and source of the drive transistor Td has become equal to the threshold voltage Vth, the flow of the drain current through the drive transistor Td stops, and therefore the voltage equal to the threshold voltage Vth is held in the pixel capacitor Cs.

Thereafter, in the signal write step S2, the control signal WS is kept at the high level, and thus the sampling transistor T1 is in the on-state, which allows a video signal potential Vsig to be sampled from the signal line SL. At this time, the source potential of the drive transistor Td is substantially the same as that in the step 1 because the capacitance of the equivalent capacitor Coled of the light-emitting element OLED is sufficiently higher than that of the pixel capacitor Cs. Consequently, a voltage of ΔVsig+Vth is held in the pixel capacitor Cs. The voltage ΔVsig satisfies the relationship ΔVsig=Vsig−Vofs.

Thereafter, when the operation sequence enters the light emission period in the light emission step 3, the control signal DS is turned to the high level again, which turns on the switching transistor T4. This connects the drive transistor Td to the power supply line Vcc, so that the drain current Ids flows into the light-emitting element OLED. As a result, due to the internal resistance of the light-emitting element OLED, the anode potential Vanode thereof (i.e., the source potential of the drive transistor) rises. At this time, the voltage written to the pixel capacitor Cs is kept as it is due to bootstrap operation, and thus the gate potential of the drive transistor Td also rises in linkage with the rise of the potential Vanode. That is, during the light emission period, a constant voltage of ΔVsig+Vth is applied between the gate and source of the drive transistor Td.

The drain current that flows through the drive transistor Td during the light emission period in the step 3 is given by Equation 1, and therefore is expressed as Equation 2. As is apparent from Equation 2, the drain current Ids does not depend on the threshold voltage Vth of the drive transistor Td.

$$\begin{aligned} Ids &= (1/2)\mu(W/L)Cox(Vgs - Vth)^2 \\ &= (1/2)\mu(W/L)Cox(\Delta Vsig + Vth - Vth)^2 \\ &= (1/2)\mu(W/L)Cox \cdot \Delta Vsig^2 \end{aligned} \quad \text{Equation 2}$$

Figure 5:
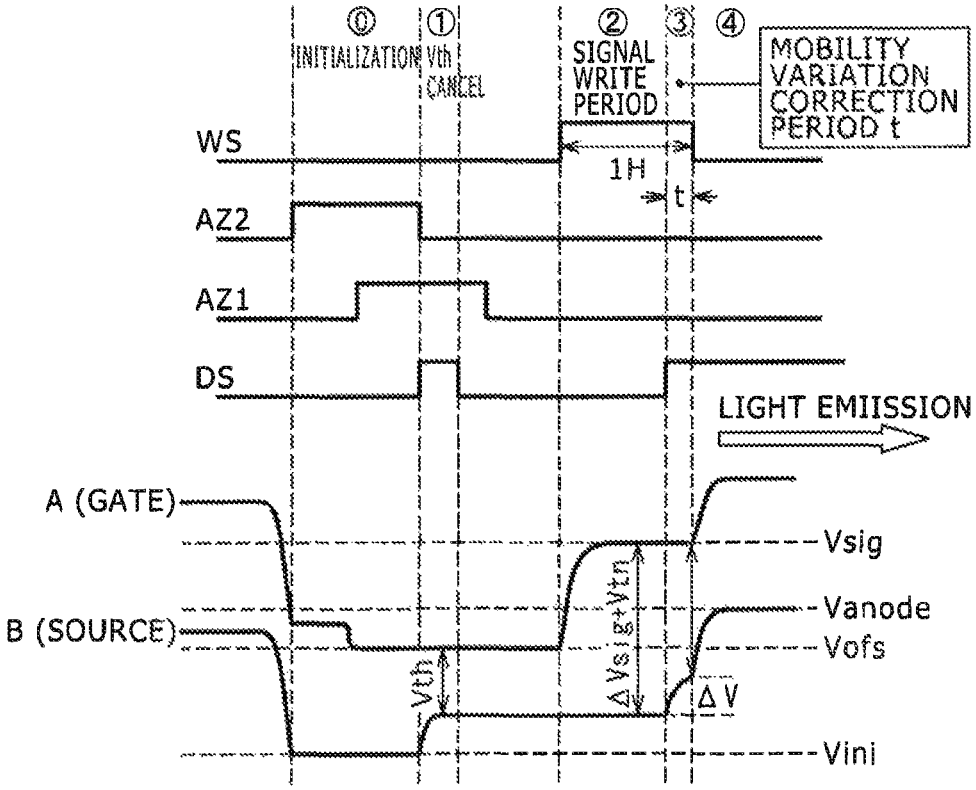
FIG. 5 is another timing chart for explaining the operation of the image display according to the related art.

FIG. 5 shows an example in which operation for correcting variation in the mobility μ of the drive transistors is added to the above-described threshold voltage correction operation. The timing chart of FIG. 5 employs the same representation manner as that of the timing chart of FIG. 4 for easy understanding. In this example, a mobility correction step 3 is carried out in the latter half of the signal write step 2. The mobility correction step 3 is followed by a light emission step 4. In the mobility correction step 3, the control signal DS is kept at the high level with the control signal WS kept at the high level. Therefore, the drain current flows through the drive transistor Td, which raises the source potential thereof by ΔV. On the other hand, the gate potential of the drive transistor Td is fixed at Vsig. As a result, the voltage Vgs of the drive transistor Td decreases by ΔV. The larger the current that flows through the drive transistor Td is, the higher the degree of the voltage decrease ΔV is. In other words, as is apparent from Equation 1 as a transistor characteristic equation, a higher mobility μ of the drive transistor Td yields a larger voltage decrease ΔV. The control signal WS is turned to the low level at the end of the step 3 and thus the operation sequence proceeds to the light emission operation of the step 4. The larger the voltage decrease ΔV is, the lower the level of the output current supplied to the light-emitting element OLED in the step 4 is. That is, negative feedback is carried out corresponding to the voltage decrease ΔV. Consequently, even when there is variation in the mobility μ of the drive transistor Td among the respective pixel circuits, this negative feedback on each pixel circuit basis can alleviate luminance unevenness attributed to the variation in the mobility.

Figure 6:
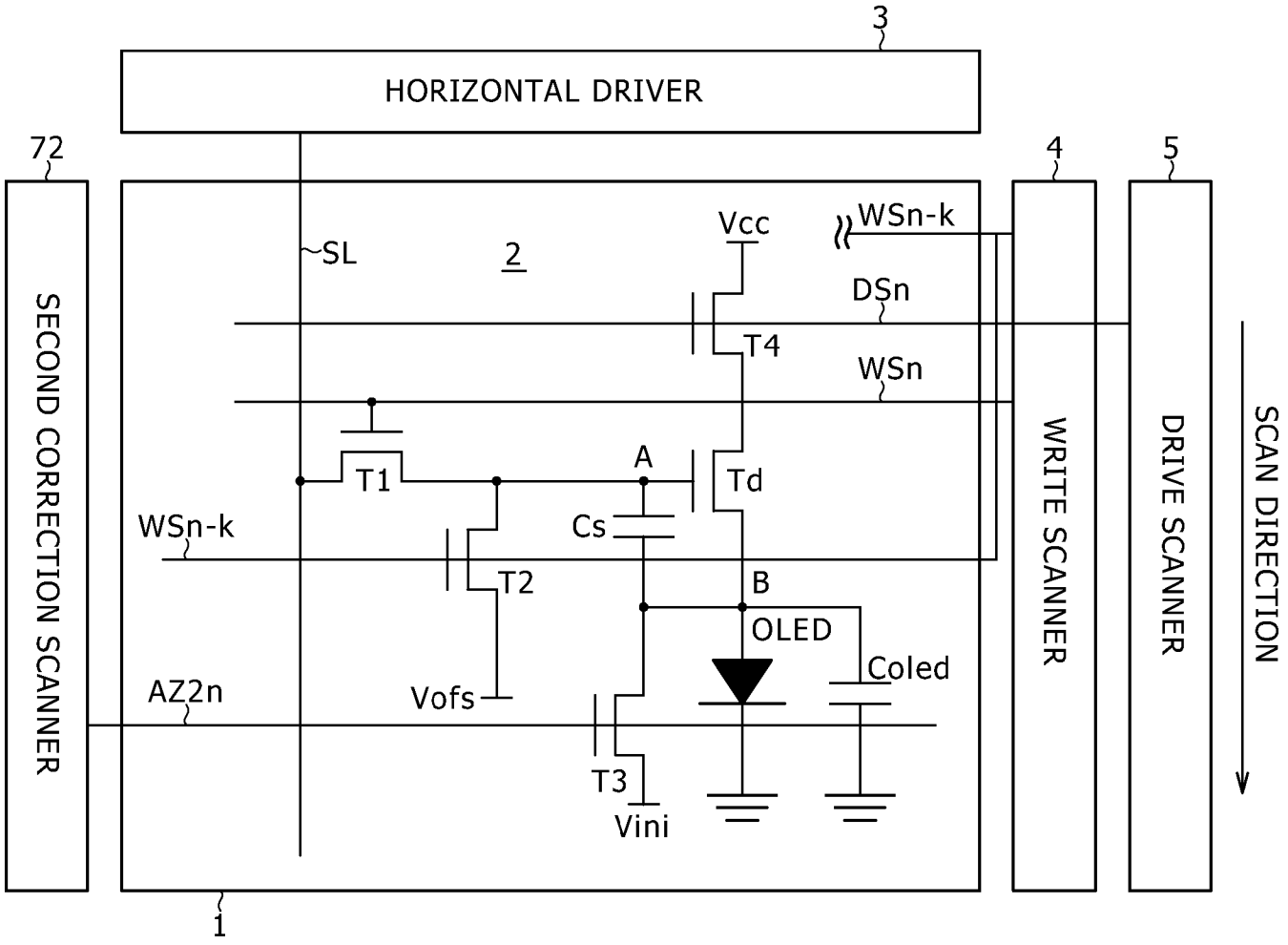
FIG. 6 is a block diagram showing an image display according to a first embodiment of the present invention.

This is the end of the description of the image display according to the related art as a basis of the present invention. Next, image displays according to embodiments of the present invention will be described below. FIG. 6 is a block diagram showing an image display according to a first embodiment of the present invention. The same parts in FIG. 6 as those in the image display according to the related art shown in FIG. 2 are given the same numerals for easy understanding. FIG. 6 shows the pixel circuit 2 on the n-th row in particular. To clearly indicate this, symbol n is added to the symbol of the scan line WS for sampling, so that this sampling scan line is indicated by symbol WSn. Similarly, the other scan lines are also given symbol n so as to be indicated by symbols DSn and AZ2*n* in order to clearly indicate that this pixel circuit 2 is on the n-th row.

The feature of the present embodiment is that the first correction scanner 71 is absent and the scan line AZ1*n* corresponding thereto is also absent. Instead of the scan line AZ1*n*, the scan line WSn-k is disposed in parallel to the sampling scan line WSn. That is, the reference potential setting transistor T2 is controlled by the sampling scan line WSn-k. This scan line WSn-k arises from branching of the sampling scan line WS on the (n−k)-th row from the top along the scan direction. In the present embodiment, k denotes a positive integer number and the scan direction is set to the downward direction. Thus, turning of the sampling scan line WSn-k to the high level is previous to turning of the sampling scan line WSn on the n-th row to the high level. In this manner, in the first embodiment, the need for the first correction scanner is eliminated through sharing of the write scanner 4 by the sampling transistor T1 and the reference potential setting transistor T2. Thereby, the number of the scanners necessary for the line-sequential scanning of the pixel array 1 is reduced to three from four in the related art example.

Figure 7:
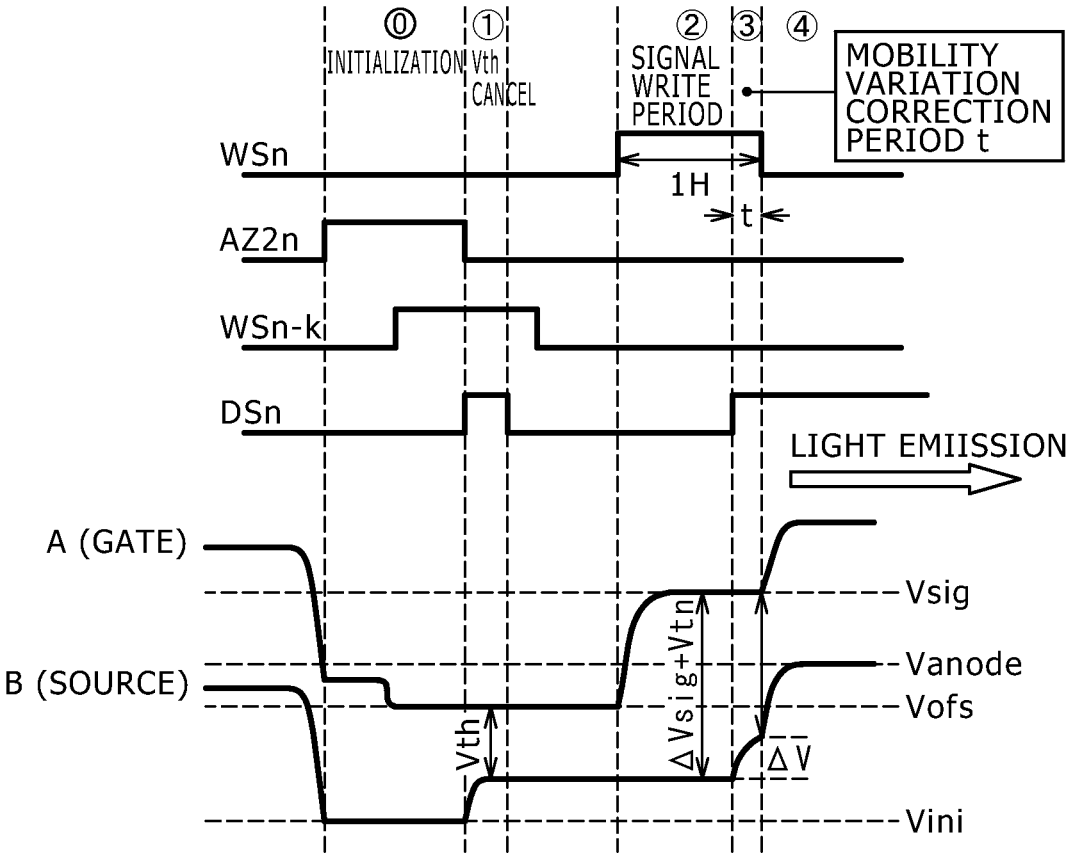
FIG. 7 is a timing chart for explaining the operation of the first embodiment.

FIG. 7 is a timing chart for explaining the operation of the first embodiment shown in FIG. 6. For easy understanding, the timing chart of FIG. 7 employs the same representation manner as that of the timing chart of FIG. 5 for explaining the operation of the image display according to the related art. As is apparent from the timing chart, the control signal WSn-k is turned to the high level prior to turning of the write control signal WSn on the n-th row to the high level. Therefore, the Vth cancel step 1 can be carried out prior to the signal write step 2. This eliminates the need for the scanner dedicated to the reference potential setting transistors T2, and thus permits simplification and cost reduction of the image display. According to the timing chart of FIG. 7, mobility variation correction is carried out in the step 3. However, the execution of the step 3 is optional, and embodiments of the present invention are effective no matter whether the step 3 is carried out or not. Also in other embodiments to be described below, the mobility variation correction step 3 is carried out. However, the present invention is not necessarily limited thereto but this step 3 may be omitted.

Figure 8:
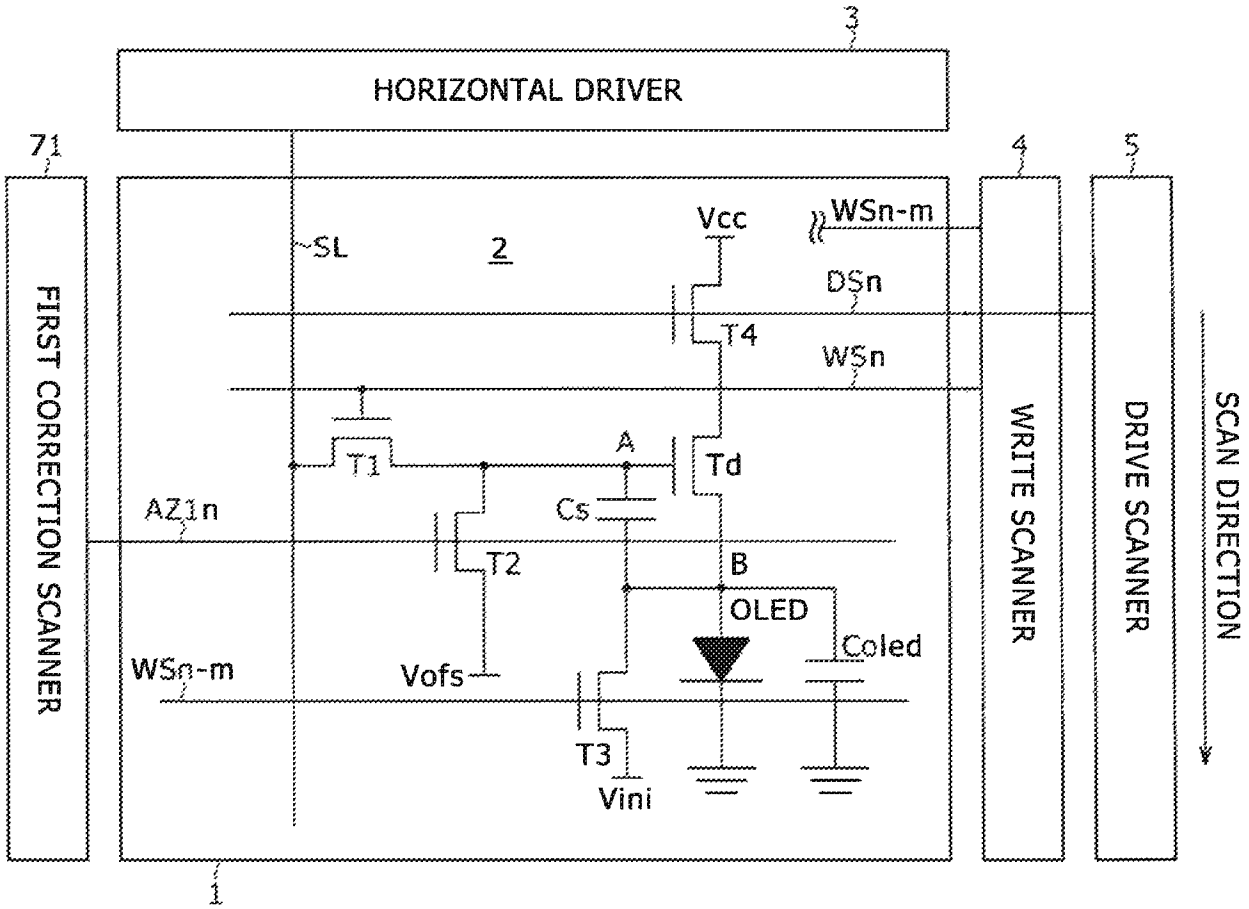
FIG. 8 is a block diagram showing an image display according to a second embodiment of the invention.

FIG. 8 is a block diagram showing an image display according to a second embodiment of the present invention. The same parts in FIG. 8 as those in the first embodiment shown in FIG. 6 are given the same numerals for easy understanding. The feature of the second embodiment is that the initialization transistor T3 is controlled by the write scan line WSn-m, i.e., by the write scan line WS on the (n−m)-th row from the top. This eliminates the need for the second correction scanner for controlling the initialization transistors T3, and thus can reduce the total number of the scanners to three.

Figure 9:
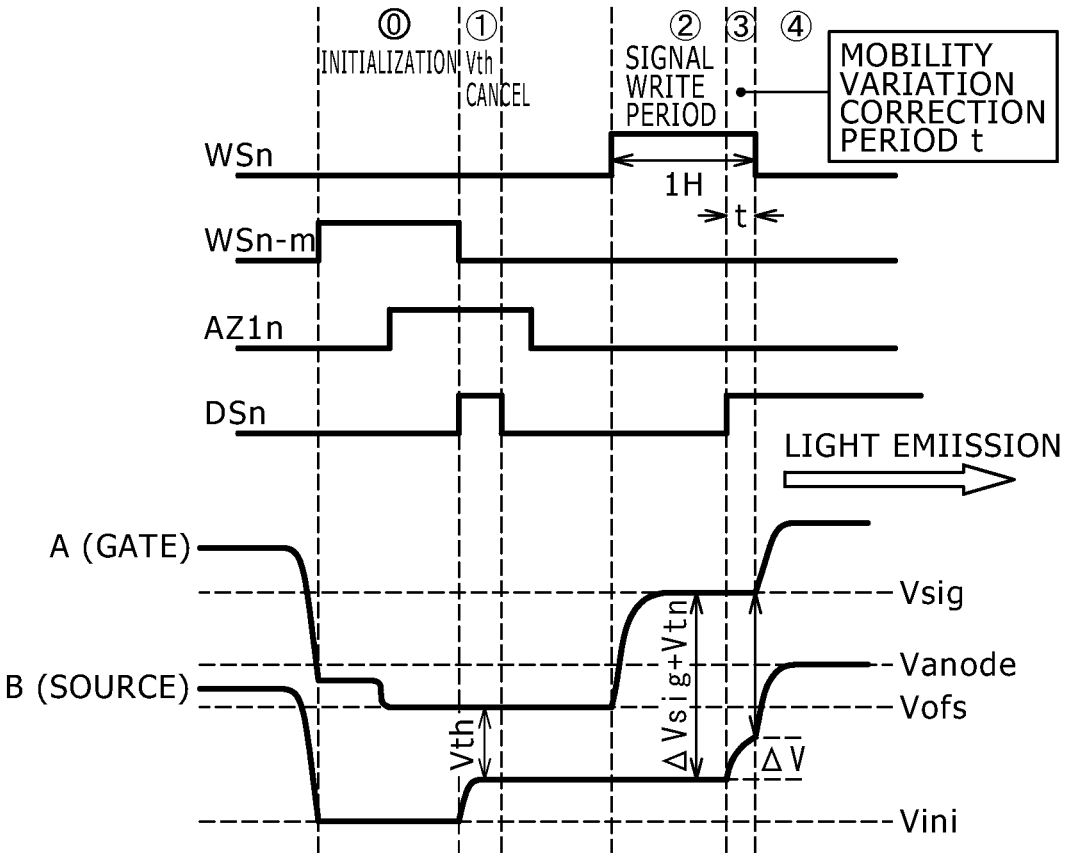
FIG. 9 is a timing chart for explaining the operation of the second embodiment.

FIG. 9 is a timing chart for explaining the operation of the image display according to the second embodiment shown in FIG. 8. The timing chart of FIG. 9 employs the same representation manner as that of the timing chart of FIG. 7 for the first embodiment for easy understanding. As shown in FIG. 9, first the control signal WSn-m is turned to the high level, and thereafter the control signals AZ1*n*, DSn, and WSn are turned to the high level in that order, so that the steps 0 to 4 are sequentially carried out. In the present embodiment, m denotes a positive integer number and the scan direction is set to the downward direction. Thus, turning of the write scan line WSn-m to the high level is previous to turning of the write scan line WSn to the high level as shown in the timing chart. The initialization step 0 is carried out through the turning of this preceding sampling control signal WSn-m to the high level, so that the source potential of the drive transistor Td is initialized to the potential Vini. Because the scanner dedicated to the initialization transistors T3 is unnecessary, simplification and cost reduction of the image display are possible.

Figure 10:
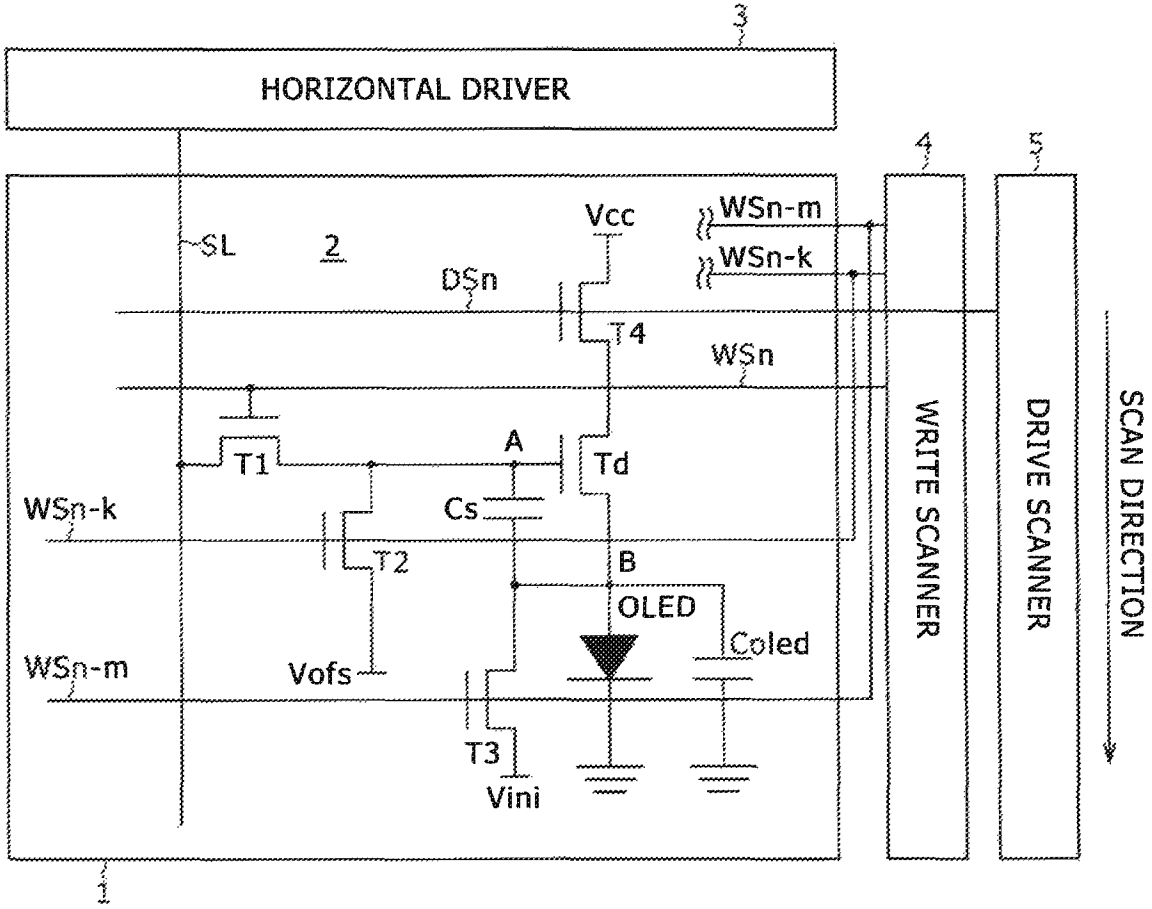
FIG. 10 is a block diagram showing an image display according to a third embodiment of the invention.

FIG. 10 is a block diagram showing an image display according to a third embodiment of the present invention. The same parts in FIG. 10 as those in the first embodiment shown in FIG. 6 are given the same numerals for easy understanding. The feature of the embodiment of FIG. 10 is that the reference potential setting transistor T2 is controlled by the write scan line WSn-k, i.e., by the write scan line WS on the (n−k)-th row from the top, and the initialization transistor T3 is controlled by the write scan line WSn-m, i.e., by the write scan line WS on the (n−m)-th row from the top. This feature allows the number of the scanners to be reduced by two.

Figure 11:
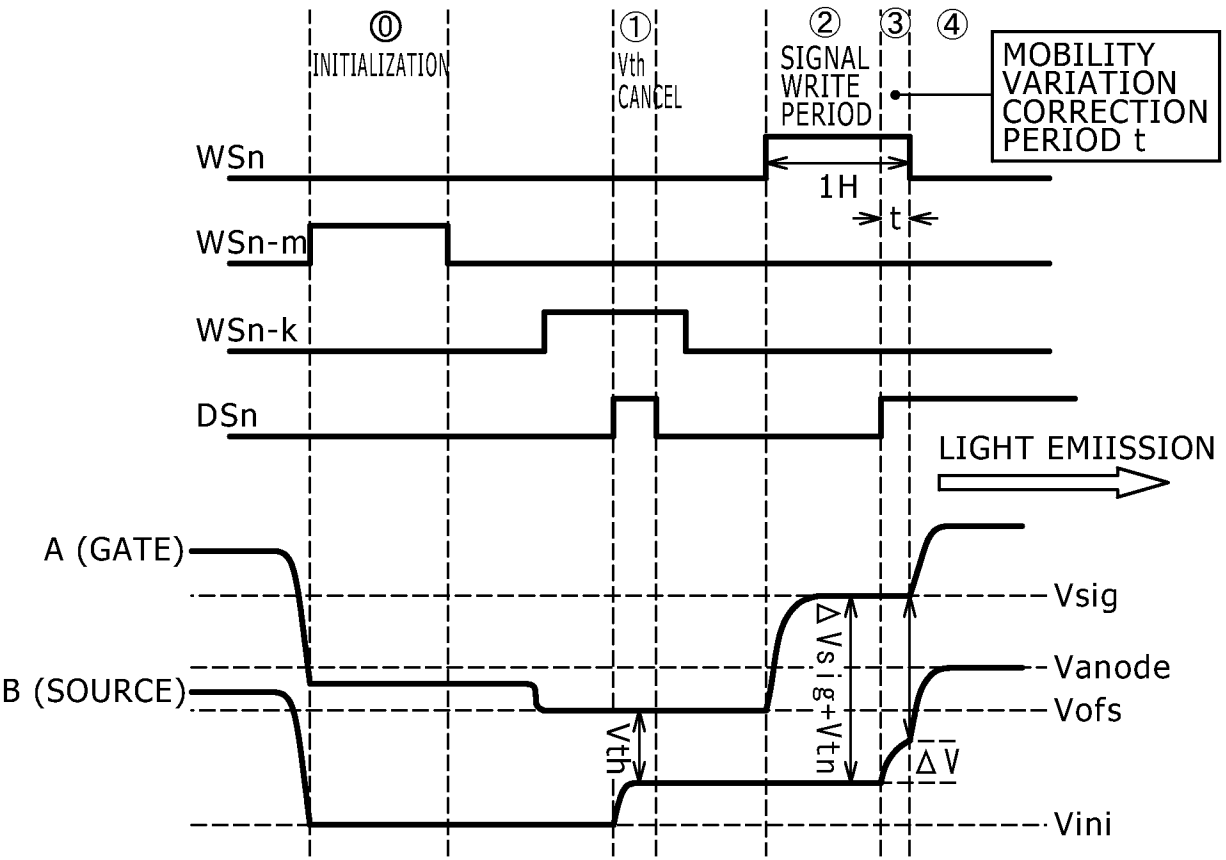
FIG. 11 is a timing chart for explaining the operation of the third embodiment.

FIG. 11 is a timing chart for explaining the operation of the third embodiment shown in FIG. 10. The timing chart of FIG. 11 employs the same representation manner as that of the timing chart of FIG. 7 for the first embodiment for easy understanding. The control signals WSn-m, WSn-k, and WSn are sequentially output from the write scanner 4. In the present embodiment, k denotes a positive integer number and m denotes a positive integer number larger than k, and the scan direction is set to the downward direction. Thus, turning of the write scan line WSn-k to the high level is previous to turning of the write scan line WSn assigned to the n-th row to the high level. Furthermore, turning of the write scan line WSn-m to the high level is previous to the turning of the write scan line WSn-k to the high level. When the control signal WSn-m is turned to the high level first, the initialization step 0 is carried out, so that the source potential of the drive transistor Td is initialized to the potential Vini. Subsequently, in the Vth cancel step 1, the control signal WSn-k is kept at the high level, so that the gate potential of the drive transistor Td is set to the reference potential Vofs. Because the control signal DSn is turned to the high level in this state, the threshold voltage Vth of the drive transistor Td is written to the pixel capacitor Cs. Thereafter, the scan line WSn on the n-th row is turned to the high level in the signal write step 2, and thus the video signal Vsig is written to the pixel capacitor Cs. The Vth cancel operation can be carried out by utilizing a preceding write control signal in this manner. Because the dedicated scanners for the initialization transistors and the reference potential setting transistors are unnecessary, simplification and cost reduction of the image display are possible.

Figure 12:
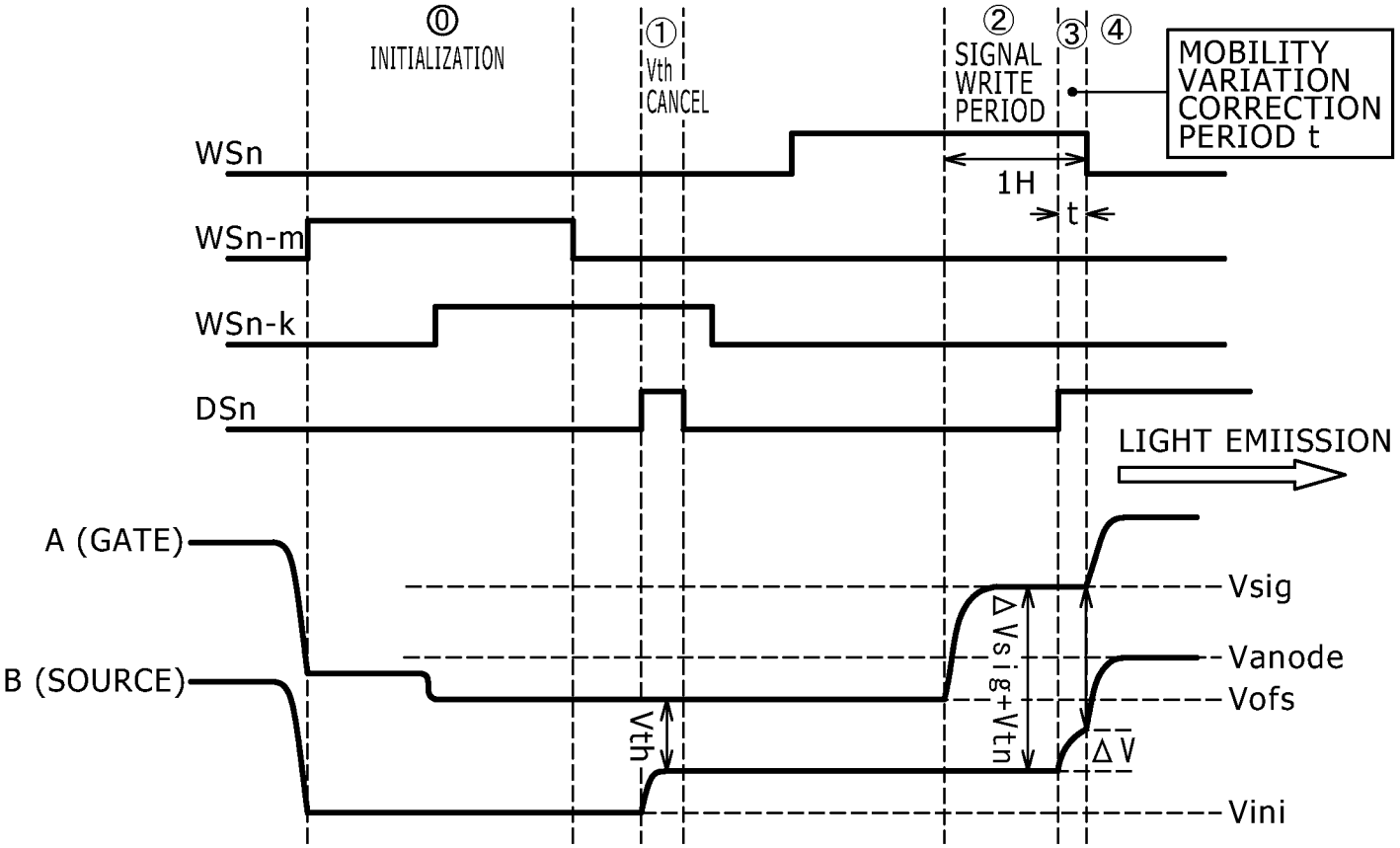
FIG. 12 is a timing chart for explaining the operation of a fourth embodiment of the invention.

FIG. 12 is a timing chart showing the operation of an image display according to a fourth embodiment of the present invention. The circuit configuration of the present embodiment is the same as that of the third embodiment shown in FIG. 10. However, the waveforms of the control signals in the fourth embodiment are different from those in the third embodiment, and correspondingly the timing chart of FIG. 12 is different from the timing chart of FIG. 11. Specifically, in the third embodiment shown in FIG. 11, the selection period of the write scan line WS is set to one horizontal scanning period (1H). In contrast, in the fourth embodiment, the selection period of the write scan line WS is set to a period longer than 1H. That is, the width of the control signal (selection pulse) applied to each write scan line WS from the write scanner is larger than 1H. As a result, the pulse width of the initialization control signal WSn-m used in the initialization step 0 is also larger than 1H. Therefore, a period longer than 1H can be ensured as the initialization period for the drive transistor Td, and thus the source potential of the drive transistor Td can be initialized to the potential Vini more surely. This allows the Vth cancel operation in the Vth cancel step 1 to be carried out more accurately.

In the timing charts of FIG. 11 and so on, m and k denote positive integer numbers satisfying the relationship m>k. Typically m and k are set to 2 and 1, respectively. Specifically, according to this setting, the reference potential setting transistor T2 is controlled by the scan line WSn−1 on the previous row of this transistor T2, and the initialization transistor T3 is controlled by the scan line WSn−2 on the further previous row.

Figure 19:
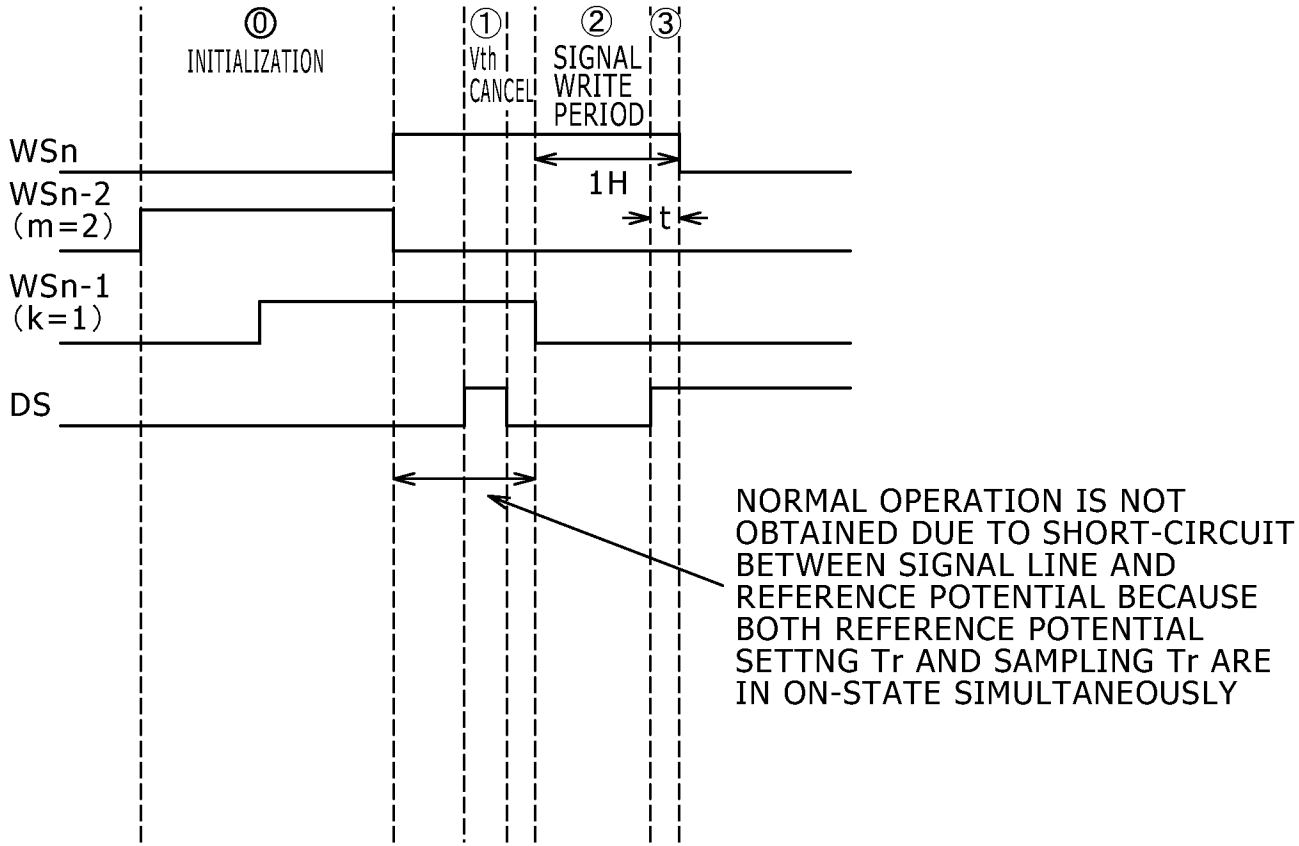
FIG. 19 is a timing chart showing a reference example for comparison with the fourth embodiment.

However, it should be noted that this setting is not necessarily available in the case of the timing chart of FIG. 12. Specifically, the selection period of the scan line is 2H in FIG. 12. Therefore, when m and k are 2 and 1, respectively, as shown in FIG. 19, the period during which both the reference potential setting transistor T2 and the sampling transistor T1 are in the on-state simultaneously exists. In this case, the signal line is short-circuited to the reference potential Vini and thus an inadequate through-current flows, which results in failure in normal Vth cancel operation.

For correct operation, it is required that the sampling transistor T1 be turned on after the reference potential setting transistor T2 has entered the off-state. Therefore, when the selection period of the scan line is 2H like in the embodiment of FIG. 12, the value of k needs to be two or more. When the selection period of the scan line is 3H or more, the value of k needs to be further increased depending on the selection period.

Figure 20:
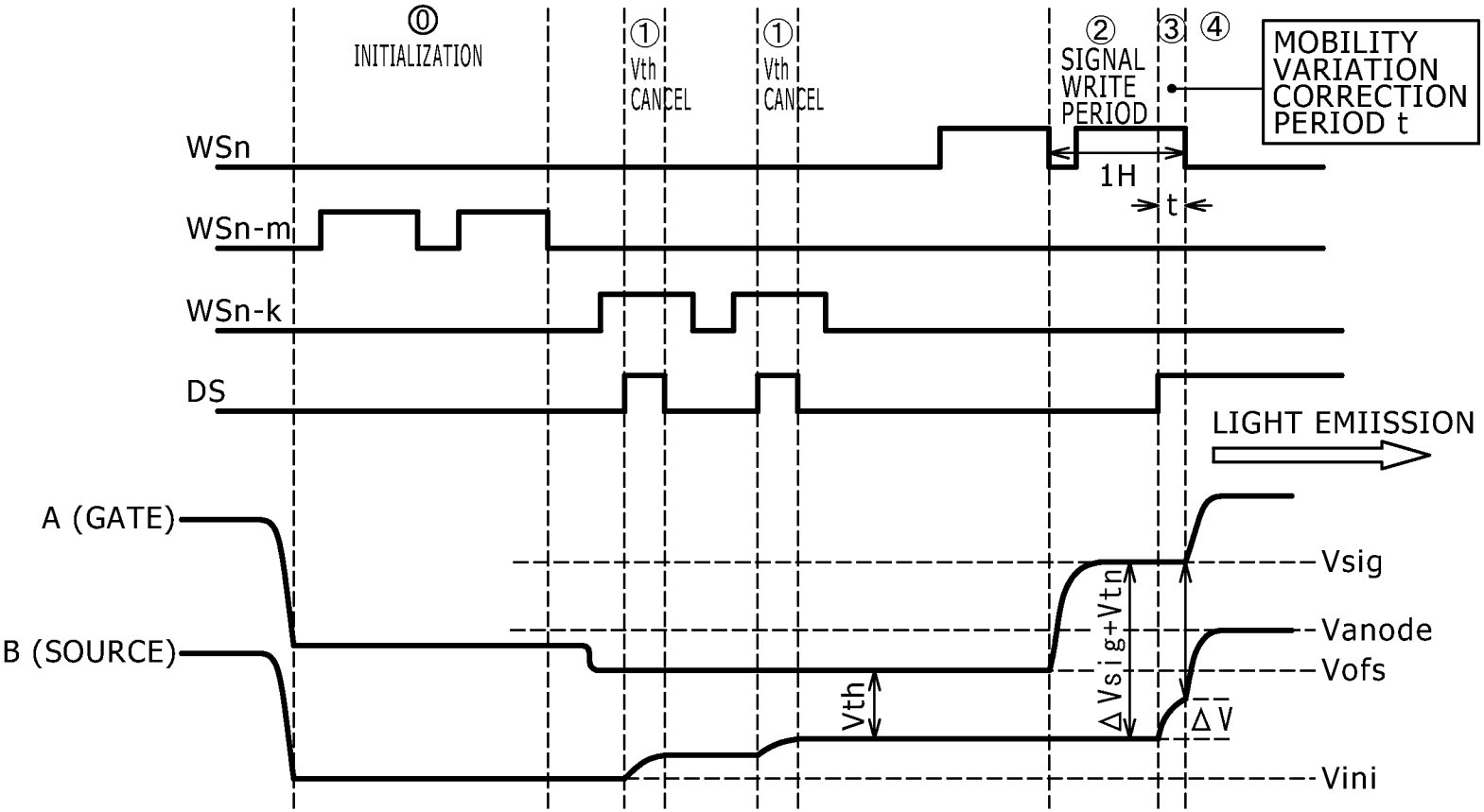
FIG. 20 is a timing chart showing a modification of the fourth embodiment.

FIG. 20 shows a modification of the embodiment of FIG. 12. In this example, the Vth cancel operation is carried out over 2H, and hence the Vth cancel operation can be carried out more surely compared with in the example of FIG. 12. Also in this example, the value of k needs to be two or more for the same reason as that of the example of FIG. 12. Although a long period is unnecessary for the Vth cancel operation in some actual cases, it is preferable that the values of k and m be set to large values because larger k and m offer higher flexibility of the timing design, as shown in the present example.

Figure 13:
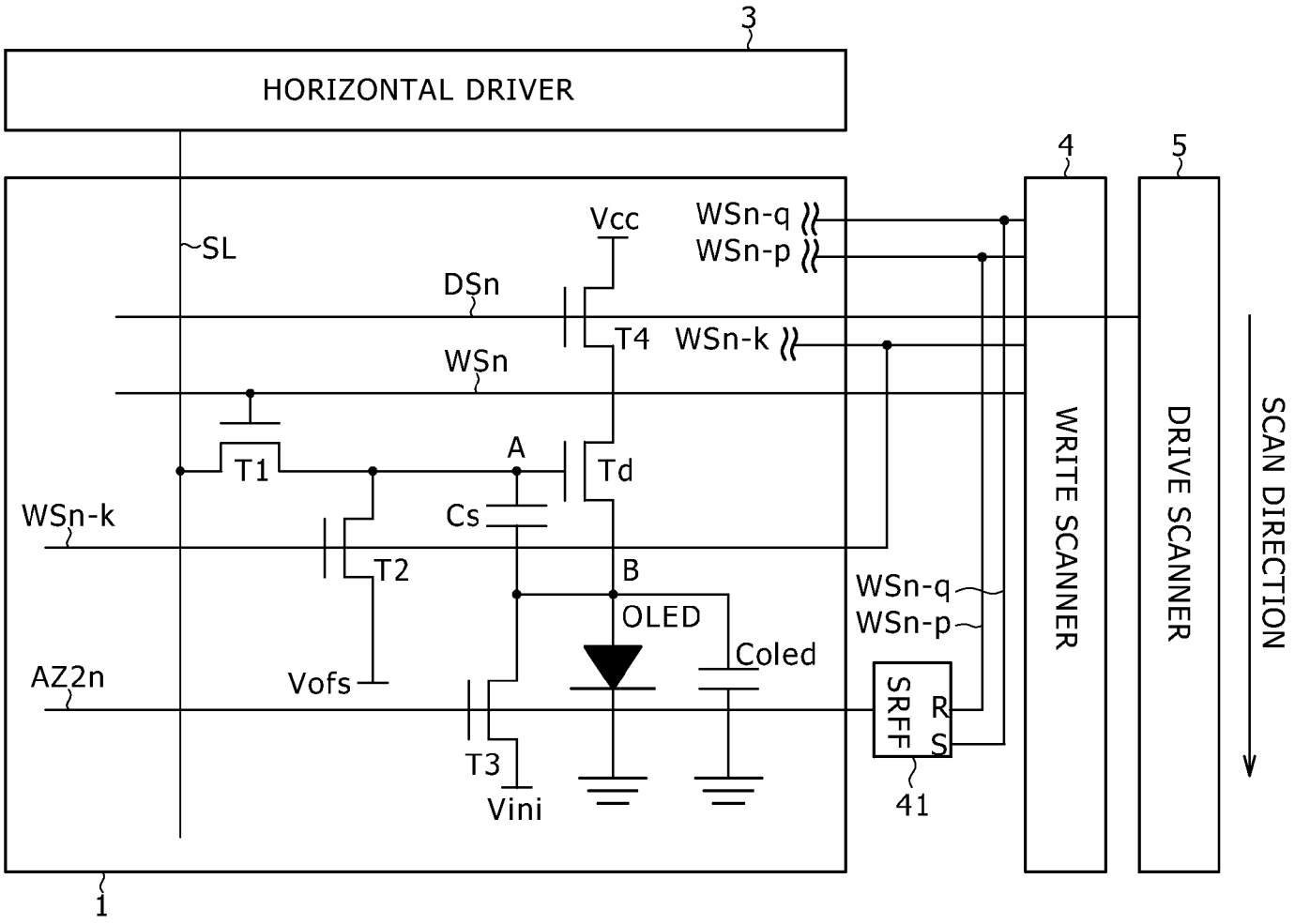
FIG. 13 is a block diagram showing an image display according to a fifth embodiment of the invention.

FIG. 13 is a block diagram showing an image display according to a fifth embodiment of the present invention. Basically the fifth embodiment is similar to the third embodiment shown in FIG. 10, and therefore the same parts in FIG. 13 as those in FIG. 10 are given the same numerals for easy understanding. The difference of the fifth embodiment from the third embodiment is that the scan line AZ2*n* is used instead of the scan line WSn-m arising from branching of a scan line on a preceding row. This scan line AZ2*n* is controlled by the write scanner 4 via an SR flip-flop (SRFF) 41. A set terminal S of the SR flip-flop 41 is supplied with a control signal WSn-q, and a reset terminal R thereof is supplied with a control signal WSn-p.

Figure 14:
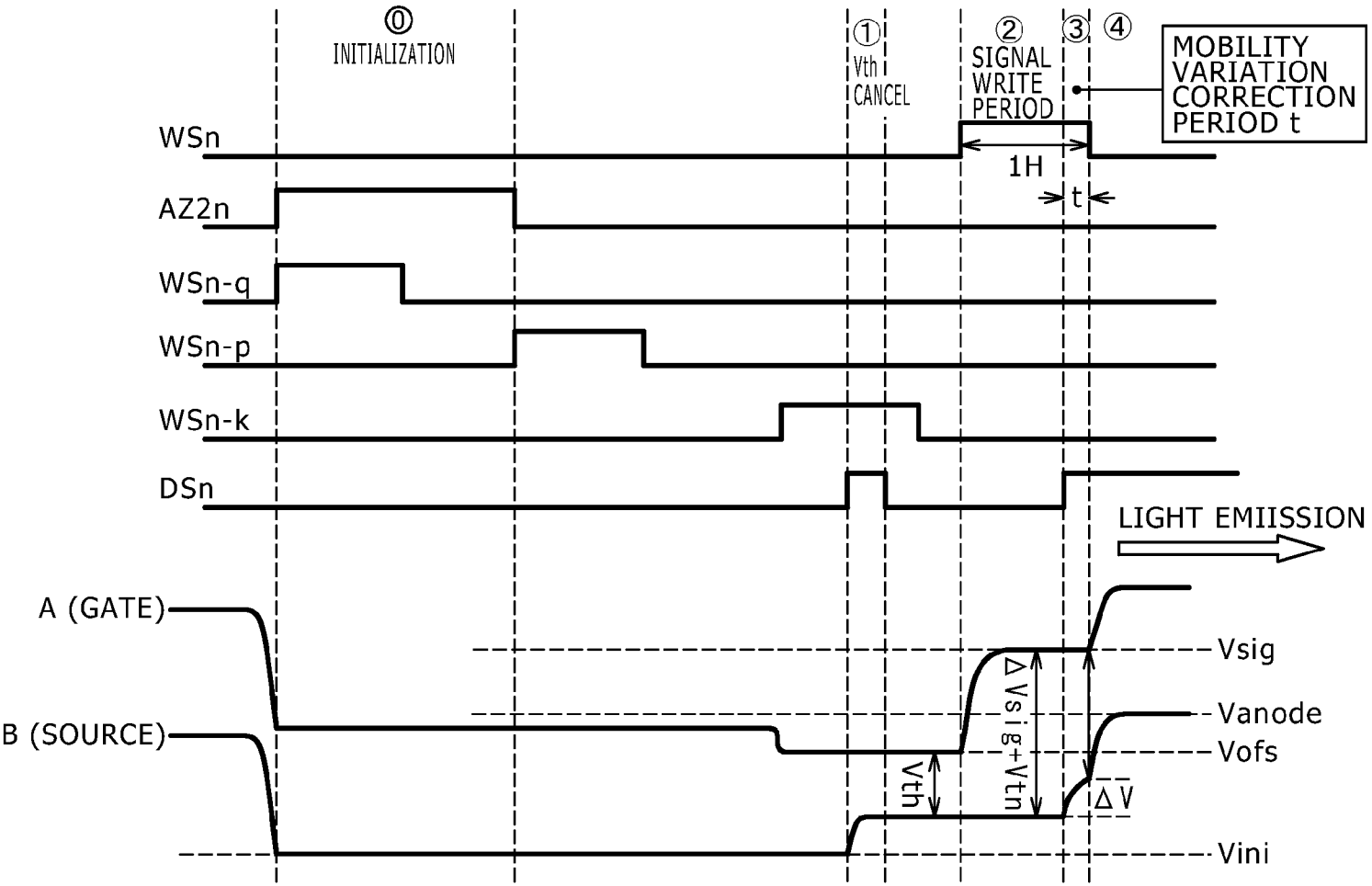
FIG. 14 is a timing chart for explaining the operation of the fifth embodiment.

FIG. 14 is a timing chart for explaining the operation of the fifth embodiment shown in FIG. 13. The timing chart of FIG. 14 employs the same representation manner as that of the timing chart of FIG. 11 for the third embodiment for easy understanding. As shown in FIG. 14, from the write scanner to the pixel circuit on the n-th row, initially the control signal WSn-q is output, and then the control signal WSn-p is output. Subsequently, the control signal WSn-k is output, and then finally the control signal WSn assigned to the n-th row is output. In the present embodiment, p denotes a positive integer number and q denotes a positive integer number larger than p, and the scan direction is set to the downward direction. Thus, as shown in the timing chart, the output of the SR flip-flop 41, i.e., the control signal AZ2*n*, is turned to the high level at the timing when the write scan line WSn-q is turned to the high level, and then is turned to the low level at the timing when the write scan signal WSn-p is turned to the high level. Depending on the way of selection of the values of p and q, the high-level period (i.e., the pulse width) of the control signal AZ2*n* can be optionally set to any period. Consequently, the initialization period of the initialization step 0 can be set to a sufficiently long period over 1H, and thus the initialization operation for the source of the drive transistor Td can be carried out more surely.

Figure 15:
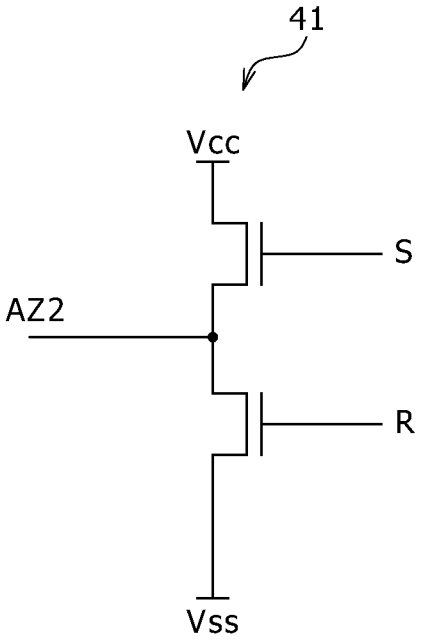
FIG. 15 is a circuit diagram showing a configuration example of a flip-flop included in the fifth embodiment.

FIG. 15 is a circuit diagram showing a configuration example of the SR flip-flop 41 included in the image display of FIG. 13. The SR flip-flop 41 is formed by connecting a pair of N-channel transistors in series to each other between the power supply line Vcc and a ground line Vss. The output signal AZ2 is obtained from the connection node between the transistors. The gate of one transistor serves as the set terminal S and the control signal WSn-q is applied thereto. The gate of the other transistor serves as the reset terminal R and is supplied with the control signal WSn-p from the write scanner 4. The SR flip-flop 41 is composed only of N-channel transistors and therefore can be formed even by an amorphous-silicon process.

Figure 16:
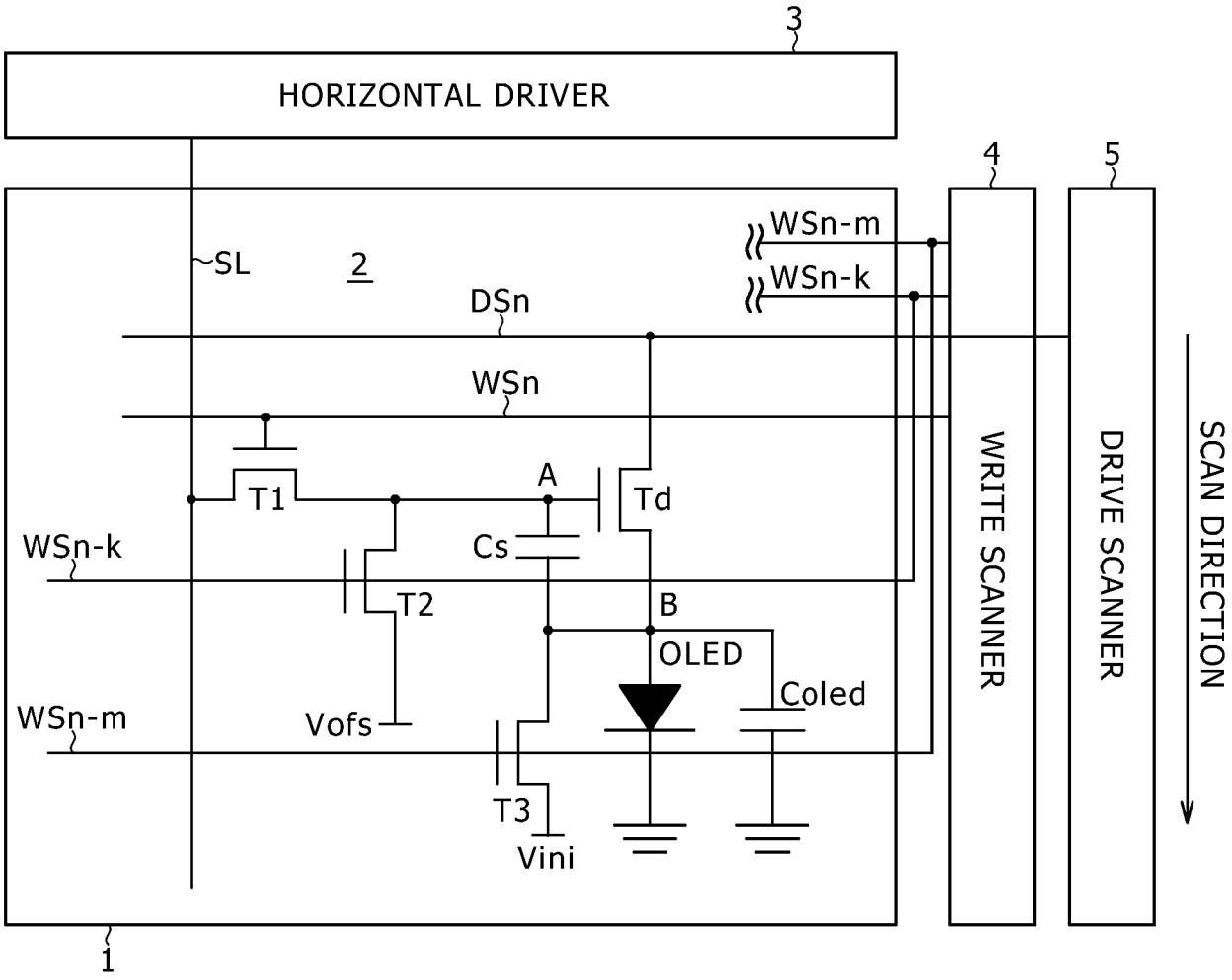
FIG. 16 is a block diagram showing an image display according to a sixth embodiment of the invention.

FIG. 16 is a block diagram showing an image display according to a sixth embodiment of the present invention. Basically the sixth embodiment is similar to the third embodiment shown in FIG. 10, and therefore the same parts in FIG. 16 as those in FIG. 10 are given the same numerals for easy understanding. The difference between the sixth and third embodiments is that in the sixth embodiment, the switching transistor T4 is absent and hence the pixel circuit 2 is formed of the total four transistors T1, T2, T3, and Td. That is, the number of the transistors as components is reduced to four from five, which can correspondingly contribute to yield improvement. To respond to the removal of the switching transistor T4, a power supply drive line DSn is disposed in the pixel circuit 2 instead of the simple power supply line Vcc. This power supply drive line DSn is controlled by the drive scanner 5 similarly to the scan line. The power supply drive line DSn supplies a supply voltage Vcc in each light emission period, so that the drive transistor Td, of which drain is connected to the corresponding power supply drive line DSn, supplies the output current Ids to the light-emitting element OLED depending on the supply voltage. The switching transistor T4 used in the third embodiment is connected between the drain of the drive transistor Td and the predetermined power supply line Vcc. During the light emission period, the switching transistor T4 conducts in response to the control signal DS so as to connect the drive transistor Td to the power supply line Vcc, so that the output current Ids flows through the light-emitting element OLED.

Figure 17:
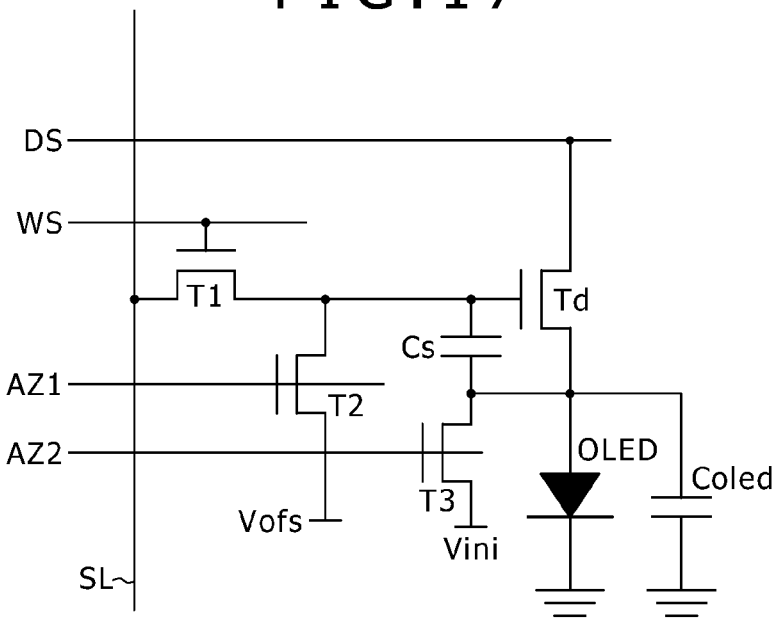
FIG. 17 is a circuit diagram showing a pixel circuit in the sixth embodiment.

FIG. 17 is a circuit diagram showing only one pixel circuit extracted from the image display according to the sixth embodiment shown in FIG. 16.

Figure 18:
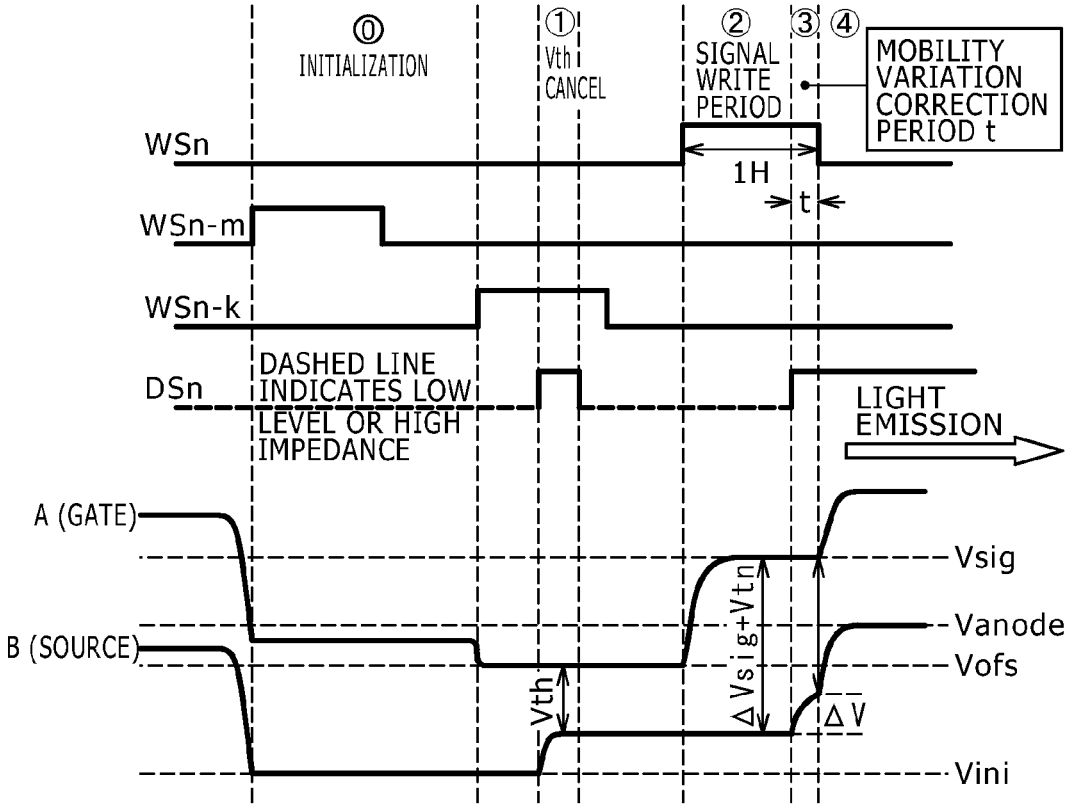
FIG. 18 is a timing chart for explaining the operation of the sixth embodiment.

FIG. 18 is a timing chart for explaining the operation of the image display according to the sixth embodiment shown in FIG. 16. The timing chart of FIG. 16 employs the same representation manner as that of the timing chart of FIG. 11 for the third embodiment for easy understanding. As shown in FIG. 18, in the Vth cancel step 1, the mobility variation correction step 3, and the light emission step 4, the power supply drive line DS is kept at the high level so as to supply the power necessary for the operation. During the other period, the power supply drive line DS is at the low level or in the high-impedance state, to thereby block the flow of the current through the drive transistor Td. This configuration can eliminate the need for the switching transistor T4. As for other respects, similarly to the above-described third embodiment, the scanners dedicated to the initialization transistors and the reference potential setting transistors are unnecessary, which allows simplification and cost reduction of the image display.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising a first pixel circuit arranged in a first pixel row, a second pixel circuit arranged in a second pixel row, and a third pixel circuit arranged in a third pixel row, each of the first, second, and third pixel circuits including:

a light-emitting element;

a sampling transistor connected to a signal line;

a drive transistor connected between a first voltage line and an anode electrode of the light-emitting element;

an initialization transistor having a first current terminal connected to a second voltage line and a second current terminal connected to the anode electrode of the light-emitting element; and a setting transistor connected having a first current terminal connected to a third voltage line and a second current terminal connected to a control terminal of the drive transistor, wherein each of the first, second, and third pixel rows includes a first scan line connected to a control terminal of the sampling transistor, a second scan line connected to a control terminal of the initialization transistor, and a third scan line connected to a control terminal of the setting transistor, the third scan line of the second pixel row is connected to the first scan line of the first pixel row, and the second scan line of the first pixel row is connected to a flip-flop circuit.

2. The display device according to claim 1, wherein the first pixel row is disposed adjacent to the second pixel row.

3. The display device according to claim 1, wherein the flip-flop circuit includes a first transistor and a second transistor disposed in series between a high potential line and a low potential line.

4. The display device according to claim 3, wherein at least one of the first transistor and the second transistor of the flip-flop circuit is a N-channel transistor.

5. The display device according to claim 1, further comprising a switching transistor connected between the first voltage line and the drive transistor.

6. The display device according to claim 1, wherein the setting transistor is directly connected to a storage capacitor.

7. The display device according to claim 6, wherein the storage capacitor is connected to the control terminal of the drive transistor.

8. An electronic apparatus having the display device according to claim 1.

9. A display device comprising a first pixel circuit arranged in a first pixel row, a second pixel circuit arranged in a second pixel row, and a third pixel circuit arranged in a third pixel row, each of the first, second, and third pixel circuits including:

a light-emitting element;

a sampling transistor connected to a signal line;

a drive transistor connected between a first voltage line and an anode electrode of the light-emitting element;

an initialization transistor having a first current terminal connected to a second voltage line and a second current terminal connected to the anode electrode of the light-emitting element; and a setting transistor connected having a first current terminal connected to a third voltage line and a second current terminal connected to a control terminal of the drive transistor, wherein each of the first, second, and third pixel rows includes a first scan line connected to a control terminal of the sampling transistor, a second scan line connected to a control terminal of the initialization transistor, and a third scan line connected to a control terminal of the setting transistor, and the second scan line of the first pixel row is connected to a flip-flop circuit.

10. The display device according to claim 9, wherein the first pixel row is disposed adjacent to the second pixel row.

11. The display device according to claim 9, wherein the flip-flop circuit includes a first transistor and a second transistor disposed in series between a high potential line and a low potential line.

12. The display device according to claim 11, wherein at least one of the first transistor and the second transistor of the flip-flop circuit is a N-channel transistor.

13. The display device according to claim 9, further comprising a switching transistor connected between the first voltage line and the drive transistor.

14. The display device according to claim 9, wherein the setting transistor is directly connected to a storage capacitor.

15. The display device according to claim 14, wherein the storage capacitor is connected to the control terminal of the drive transistor.

16. An electronic apparatus having the display device according to claim 9.

* * * * *